US010655197B2

(12) United States Patent
Burger et al.

(10) Patent No.: US 10,655,197 B2
(45) Date of Patent: May 19, 2020

(54) DETERMINING THE FERRITE PHASE FRACTION AFTER HEATING OR COOLING OF A STEEL STRIP

(71) Applicant: PRIMETALS TECHNOLOGIES AUSTRIA GMBH, Linz (AT)

(72) Inventors: Rainer Burger, Nuremberg (DE); Robert Linsbod, Linz (AT); Bernd Linzer, Sipachzell (AT); Josef Mikota, Gallneukirchen (AT); Axel Rimnac, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 1097 days.

(21) Appl. No.: 14/888,821

(22) PCT Filed: Apr. 4, 2014

(86) PCT No.: PCT/EP2014/056779
§ 371 (c)(1),
(2) Date: Nov. 3, 2015

(87) PCT Pub. No.: WO2014/177341
PCT Pub. Date: Nov. 6, 2014

(65) Prior Publication Data

US 2016/0076119 A1 Mar. 17, 2016

(30) Foreign Application Priority Data

May 3, 2013 (AT) ..... A 371/2013
Sep. 26, 2013 (AT) ..... A 50620/2013

(51) Int. Cl.
*C21D 11/00* (2006.01)
*C21D 9/56* (2006.01)
(Continued)

(52) U.S. Cl.
CPC ..... *C21D 11/00* (2013.01); *C21D 1/54* (2013.01); *C21D 8/0205* (2013.01);
(Continued)

(58) Field of Classification Search
CPC ..... C21D 11/00; C21D 11/005; C21D 1/54; C21D 2211/001; C21D 2211/005;
(Continued)

(56) References Cited

U.S. PATENT DOCUMENTS 6,679,626 B2 1/2004 Gramckow et al. ..... 374/43
6,686,735 B2 2/2004 Daalmans et al. ..... 324/243
(Continued)

FOREIGN PATENT DOCUMENTS

AT 408623 B 1/2002
CN 201915121 U 8/2011
(Continued)

OTHER PUBLICATIONS

International Search Report dated Aug. 11, 2014 issued in corresponding International application No. PCT/EP2014/056779.
(Continued)

*Primary Examiner* — Veronica F Faison
(74) *Attorney, Agent, or Firm* — Ostrolenk Faber LLP

(57) ABSTRACT

A method for determining the ferrite phase fraction $x_a$ after heating or when cooling a steel strip (2) in a metallurgic system. Also, a device for carrying out the method. A method by which the ferrite phase fraction in the steel strip (2) can be determined online, quickly and easily, includes measuring a width $w_1$ and a temperature $T_1$ of the steel strip (2), wherein the steel strip (2) comprises a ferrite phase fraction $x_a$ 1 during the measurements; heating or cooling the steel strip (2); when heating the steel strip (2) a phase conversion at least in part occurs, a→y from the ferrite state a into the austenitic state y and when cooling the steel strip
(Continued)

a phase conversion at least in part occurs, from the austenitic state y into the ferrite state a; measuring of a width w and a temperature T of steel strip (2) converted at least in part; determining the ferrite phase fraction of the formula (I), wherein $T_0$ is a reference temperature and $a_a$ and $a_y$ are the linear heat expansion coefficients of ferrite and austenite.

15 Claims, 3 Drawing Sheets

(51) Int. Cl.
*C21D 1/54* (2006.01)
*C21D 8/02* (2006.01)
*C21D 9/54* (2006.01)

(52) U.S. Cl.
CPC ..... *C21D 8/0226* (2013.01); *C21D 9/54* (2013.01); *C21D 9/56* (2013.01); *C21D 9/562* (2013.01); *C21D 11/005* (2013.01); *C21D 2211/001* (2013.01); *C21D 2211/005* (2013.01)

(58) Field of Classification Search
CPC ..... C21D 8/0205; C21D 8/0226; C21D 9/54; C21D 9/56; C21D 9/562
See application file for complete search history.

(56) References Cited

U.S. PATENT DOCUMENTS

| | | | | |
|---|---|---|---|---|
| 7,938,917 | B2 | 5/2011 | Okamoto et al. | 148/505 |
| 2007/0151635 | A1* | 7/2007 | Sano | B21B 37/44 148/508 |
| 2007/0276638 | A1* | 11/2007 | Borchers | C21D 11/005 703/6 |
| 2008/0135137 | A1 | 6/2008 | Okamoto et al. | |
| 2010/0131092 | A1 | 5/2010 | Schmors et al. | |
| 2010/0219567 | A1* | 9/2010 | Imanari | C21D 1/26 266/44 |

FOREIGN PATENT DOCUMENTS

| | | | |
|---|---|---|---|
| DE | 19941736 | A1 | 3/2001 |
| DE | 10256750 | A1 | 6/2004 |
| DE | 19881711 | B4 | 7/2012 |
| JP | S59129717 | A | 7/1984 |
| JP | 2002294351 | A | 10/2002 |
| JP | 2012011448 | A | 1/2012 |
| JP | 2012201956 | A | 10/2012 |
| KR | 20080100162 | A | 11/2008 |
| RU | 2 060 846 | C1 | 5/1996 |
| RU | 2 064 672 | C1 | 7/1996 |
| RU | 2 150 121 | C1 | 5/2000 |
| RU | 2 363 740 | C2 | 8/2009 |
| WO | WO 2004042480 | A1 | 5/2004 |
| WO | WO 2005099923 | A1 | 10/2005 |

OTHER PUBLICATIONS

Written Opinion dated Aug. 11, 2014 issued in corresponding International application No. PCT/EP2014/056779.
"Magnetische Bauteile Und Baugruppen." Jun. 25, 2009. Web. Aug. 19, 2015. <http://www.attempo.com/Daten/Kernmaterialien.pdf>.
"Info-Sheet No. 4—Selected Properties of NiTl-based Alloys." Web. Aug. 19, 2015. <http://www.memory-metalle.de/html/03_knowhow/PDF/MM_04_properties_e.pdf >.
Austrian Search Report dated Nov. 14, 2014 issued in corresponding Austrian patent application No. A50620/2013.
Austrian Search Report dated Nov. 22, 2013 issued in corresponding Austrian patent application No. A371/2013.
Office Action dated Feb. 19, 2018 issued in corresponding Russian Patent Application No. 2015141153/02(06346) without English translation.

* cited by examiner

Fig 1A
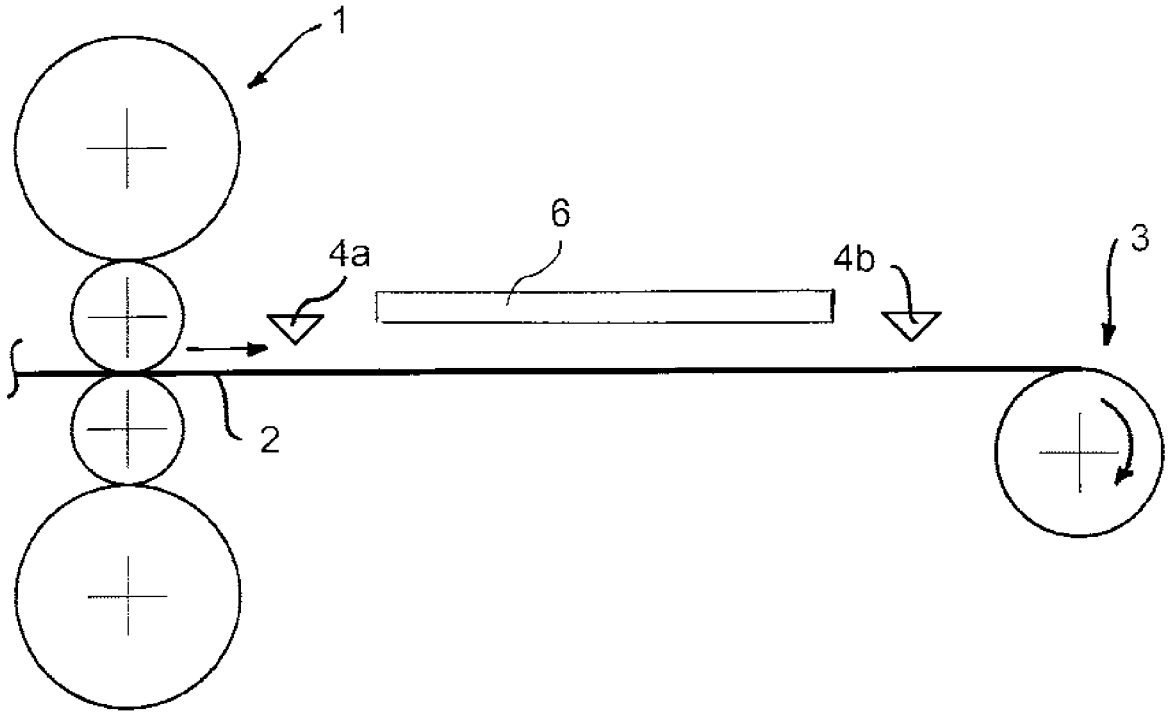
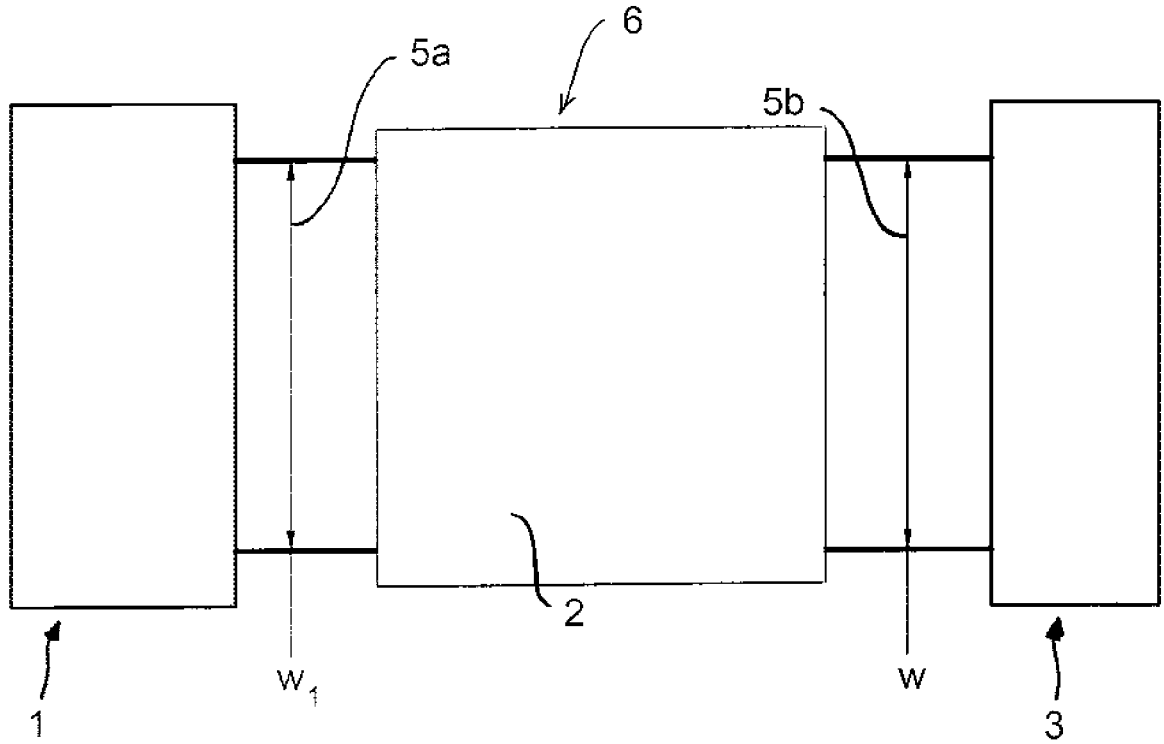
Fig 1B

DETERMINING THE FERRITE PHASE FRACTION AFTER HEATING OR COOLING OF A STEEL STRIP

CROSS-REFERENCE TO RELATED APPLICATIONS

The present, application is a 35 U.S.C. §§ 371 national phase conversion of PCT/EP2014/056779, filed Apr. 4, 2014, which claims priority of Austrian Patent Application No. A371-2013, filed May 3, 2013, the contents of which are incorporated by reference herein, and A50620/2013, filed Sep. 26, 2013, the contents of which are incorporated by reference herein. The PCT International Applications were published in the German language.

FIELD OF TECHNOLOGY

The present invention relates to a method and a computer program product for determining the ferritic phase fraction $x_\alpha$ after heating or cooling of a steel strip in a metallurgical system, such as an annealer or a cooling zone. In addition the invention relates to a device for carrying out the method.

PRIOR ART

A known method in the prior art is to determine the phase fractions in a steel strip using what is known as Barkhausen noise or by measuring the magnetic hysteresis. Another known method is to determine the phase fractions in a steel strip using what is known as post-mortem analysis, comprising the steps of taking a sample, preparing the sample and a metallurgical analysis of the prepared sample. Post-mortem analysis enables conclusions to be drawn indirectly (i.e. via the structure) about the process conditions present in a cooling or heating zone.

The disadvantage of measuring the Barkhausen noise or measuring the magnetic hysteresis is that the measuring head must be moved very close to the strip. Additional measuring devices, which are often not present in a metallurgical system, are also necessary. This results in a considerable extra outlay in apparatus and personnel.

The disadvantage of post-mortem analysis is that conclusions can only be drawn about reaching the required characteristics of the embodied structure long after the manufacturing of the steel strip. The long time delay during post-mortem analysis means that it cannot be used for the regulated balancing out of transient conditions during the manufacturing of the steel strip—e.g. for a slowing down of the casting speed because of a change of ladle, which is accompanied in a continuous casting system by a reduction in the throughput speed of the steel strip through a cooling zone.

SUMMARY OF THE INVENTION

The object of the invention is to overcome the disadvantages of the prior art and to specify a method, a computer program product and a device for determining the ferritic phase fraction after heating or cooling of a steel strip, with which the ferritic phase fraction can be determined

- online, i.e. without interrupting ongoing operation,
- quickly, i.e. within a short time for measurement and evaluation,
- with the simplest possible means, i.e. without expensive measurement devices,

- without a complex evaluation, and
- with sufficiently high precision.

This object is achieved by a method disclosed herein for determining the ferritic phase fraction $x_\alpha$ after heating or cooling of a steel strip.

In concrete terms the method has the following method steps:

- Measuring a width $w_1$ and a temperature $T_1$ of the steel strip, wherein the steel strip has a ferritic phase fraction $x_{\alpha 1}$ during the measurements;
- Heating or cooling the steel strip, wherein a phase conversion $\alpha \rightarrow \gamma$ from a ferritic state $\alpha$ into an austenitic state $\gamma$ takes place at least partly in the steel strip during heating and at least a partial phase conversion from an austenitic state $\gamma$ into a ferritic state $\alpha$ takes place in the steel strip (2) during cooling;
- Measuring a width w and a temperature T of the at least partly converted steel strip;
- Determining the ferritic phase fraction $x_\alpha$ through $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]},$$

wherein

- $T_0$ is a reference temperature and
- $\alpha_\alpha$ and $\alpha_\gamma$ are the linear coefficients of thermal expansion of ferrite and austenite.

In this case—typically either directly after the austenitic finish rolling (wherein the steel strip has an entirely austenitic structure in the last roll stand during the last rolling pass) of the steel strip in a hot-rolling mill or immediately after cooling (wherein the steel strip after cooling has an entirely ferritic structure) of the steel strip—the width $w_1$ and the temperature $T_1$ of the steel strip are measured, wherein the steel strip has a ferritic phase fraction $x_{\alpha 1}$. This ferritic phase fraction $x_{\alpha 1}$ is either sufficiently well known from process management (e.g. after austenitic finish rolling with $x_{\alpha 1}=0$) or is determined once by methods for determining the phase fractions according to the prior art. The two measurements for determining the width $w_1$ and the temperature $T_1$ are preferably made in a non-contact manner, e.g. by an optical width measurement or a pyrometer. For the greatest possible precision it is advantageous for both measurements to be made approximately at the same time on the same section of the—typically uncut—strip. Subsequently the steel strip is heated (e.g. in a heating zone) or cooled, e.g. in a cooling zone.

During cooling the structure of the steel strip is converted at least partly from the austenitic state $\gamma$ (i.e. from austenite) into a ferritic state $\alpha$ (e.g. into a ferrite or a martensite . . . ). During heating the structure of the steel strip is converted at least partly from a ferritic state $\alpha$ into the austenitic state $\gamma$.

After the heating or cooling of the steel strip the width w and the temperature T of the at least partly converted steel strip are determined once again. Here too it is advantageous for both measurements to be made approximately at the same time on the same section of the strip.

Finally the ferritic phase fraction $x\alpha$ is determined by the formula $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]},$$

wherein for determination of the ferritic phase fraction $x_\alpha$, just a few physical parameters for the steel strip, such as the linear thermal expansion functions $\alpha_\gamma$ for austenite and $\alpha_\alpha$ for ferrite, as well as the widths $w_1$ and w, and the temperature $T_1$ and T, are used. These functions are typically assumed as linear; their parameters mainly referred to in the literature as linear thermal expansion coefficients—are known to the person skilled in the art Finally $T_0$ involves a reference temperature of typically 20° C.

In an alternate form of embodiment of the invention the so-called spatial coefficient of thermal expansion is used instead of the linear coefficient of thermal expansion. In such cases conclusions are drawn about the ferritic phase fraction via the changes in length and width of the steel strip during cooling.

The invention enables the converted fraction of the structure to be determined online, i.e. during ongoing operation of a metallurgical system, with a sufficiently high precision and essentially by mechanisms which are typically already present in metallurgical systems. In addition the phase fraction occurring—increased or reduced during the observed process step—can be evaluated easily and quickly by the above formula.

There is a large class of areas of application in practical terms. In concrete terms, in the method for determining the ferritic phase fraction $x_\alpha$ after the heating of a steel strip, the following method steps are carried out:

Measuring the width $w_1$ and the temperature $T_1$ of the steel strip, wherein the steel strip is entirely in a ferritic state with $x_{\alpha 1}=1$ during the measurement;

Heating the steel strip, wherein a phase conversion $\alpha \rightarrow \gamma$ from a ferritic state $\alpha$ into the austenitic state $\gamma$ takes place at least partly;

Measuring a width w and a temperature T of the at least partly converted steel strip;

Determining the ferritic phase fraction $x_\alpha$ through $$x_\alpha = \frac{-w - w\alpha_\alpha(T_1 - T_0) + w_1 + w_1\alpha_\gamma(T - T_0)}{w_1[-\alpha_\alpha(T - T_0) + \alpha_\gamma(T - T_0)]}.$$

In this method it is assumed that initially the steel strip is present entirely in a ferritic state; this is often the case if the steel strip is cooled before, preferably immediately before, the measurement of the width $w_1$ and the temperature $T_1$ in a cooling zone (e.g. a laminar cooling zone).

In the technically important case of heating the steel strip by annealing, the width w and the temperature T of the at least partly converted steel strip are measured during and/or after the annealing.

During annealing it is especially advantageous for the annealing duration and/or the annealing temperature during annealing to be set, preferably under closed-loop control, as a function of the ferritic phase fraction $x_\alpha$.

The annealing duration can be set easily via the speed at which the strip passes through the annealer. However it should be noted here that the passage speed of the strip also changes the throughput through the annealer. With direct-coupled operation of an annealer with a rapid cooling zone, the speed during rapid cooling (also quenching) is also changed by changing the passage speed of the strip.

The annealing temperature is usually set by burners.

For example during intercritical annealing in a continuous annealer, for smaller and rapid corrections of the ferritic phase fraction $x_\alpha$, the passage speed can be changed and immediately thereafter the annealing temperature can be adjusted, since the annealing temperature can naturally be adapted more slowly than the passage speed. Subsequently the passage speed of the strip is successively taken back to the desired speed, wherein the annealing temperature is adapted in parallel thereto, so that the actual phase fraction $x_\alpha$ corresponds to the required phase fraction as precisely as possible.

In any event setting the annealing duration and/or the annealing temperature under open-loop or closed-loop control enables the actual structure composition to be set to the required structure composition. The target structure is achieved especially precisely if the annealing duration and/or the annealing temperature are set under closed-loop control. With closed-loop control setting of the annealing duration a required-actual comparison is made between the required phase fraction and the actual phase fraction $x_\alpha$, wherein the annealing is continued until the actual phase fraction $x_\alpha$ corresponds to the required phase fraction as precisely as possible. With closed-loop control setting of the annealing temperature, as a function of a required-actual comparison between the required phase fraction and the actual phase fraction $x_\alpha$, the annealing temperature is adapted until the actual phase fraction $x_\alpha$ corresponds to the required phase fraction as precisely as possible.

There is a further technically important special case of the inventive method for determining the ferritic phase fraction after the cooling of a steel strip. In concrete terms the following method steps are carried out:

Measuring the width $w_1$ and the temperature $T_1$ of the steel strip, wherein the steel strip is entirely in the austenitic state with $x_{\alpha 1}=0$ during the measurement;

Cooling the steel strip, wherein at least a partial phase conversion from the austenitic state $\gamma$ into a ferritic state a takes place in the steel strip;

Measuring a width w and a temperature T of the at least partly converted steel strip;

Determining the ferritic phase fraction $x_\alpha$ through $$x_\alpha = \frac{-w - w\alpha_\gamma(T_1 - T_0) + w_1 + w_1\alpha_\gamma(T - T_0)}{w_1[-\alpha_\alpha(T - T_0) + \alpha_\gamma(T - T_0)]}.$$

This special case especially occurs when the steel strip is finish-rolled in the austenitic state, i.e. the steel strip leaves the last roll stand of the finish-rolling train in the austenitic state and is subsequently cooled.

It is especially advantageous for the steel strip to be hot-rolled before, preferably immediately before, the measurement of the width $w_1$ and the temperature $T_1$. In the preferred form of embodiment a partial phase conversion from the austenitic state between the hot-rolling and the measurements of $w_1$ and $T_1$ is prevented.

Typically the steel strip is cooled in a cooling zone after measurement of the width $w_1$ and the temperature $T_1$.

During hot-rolling it can be expedient for the measurement of the width w and the temperature T of the at least partly converted steel strip to be undertaken immediately before coiling. However these measurements could also take place previously, e.g. during or after cooling in a cooling zone.

The phase conversion can be set especially precisely if the cooling is set during cooling in the cooling zone as a function of the ferritic phase fraction $x_\alpha$ determined in this way.

In the simplest case the cooling zone is set under open-loop control. Phase conversion is controlled especially precisely under closed-loop control, i.e. by a required-actual comparison, wherein the deviation between the required value and the actual value of the ferritic phase fraction is used for setting the cooling zone. This enables the degree of conversion in the cooling zone to be pre-specified precisely even under transient operating conditions.

The cooling can be set for example as a function of the ferritic phase fractions $x_\alpha$ under open-loop control, or preferably under closed-loop control, using the cooling duration and/or the cooling intensity.

A computer program product for carrying out the inventive method, to which values for the width $w_1$ and the temperature $T_1$ before the at least partial phase conversion, the width w and the temperature of the steel strip after the at least partial phase conversion and physical parameters of the steel strip are able to be supplied, has a computing module for computing the ferritic phase fraction $x_\alpha$ $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]}.$$

Thus the computer program product can be loaded into a computer which carries out the inventive method, for example in a metallurgical system.

A device for determining the ferritic phase fraction $x_\alpha$ after heating or cooling of a steel strip in a cooling zone, especially for carrying out the inventive method, has

- a first temperature measuring device for measuring $T_1$ and a first width measuring device for measuring $w_1$;
- a second temperature measuring device for measuring T and a second width measuring device for measuring w, wherein the first temperature measuring device and the first width measuring device are disposed before a heating or a cooling zone and the second temperature measuring device and the second width measuring device are disposed after the heating or the cooling zone; and
- a computing unit for determining the ferritic phase fraction $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]},$$

wherein the computing unit is connected for signaling purposes to the first temperature measuring device, the first width measuring device, the second temperature measuring device and the second width measuring device.

It is possible to influence the phase conversion during the operation of the inventive device if the cooling zone has at least one cooling nozzle with a setting device or the heating zone has at least one heating element with a setting device, wherein the computing unit is connected for signaling purposes to the setting device, so that the ferritic phase fraction can be set.

The setting device can be embodied in a cooling zone as a valve, for example a ball valve with rotary drive, wherein a cooling medium (e.g. water, air or water with air) flows through the valve. In another form of embodiment the speed of a centrifugal pump can be set for example, by which the pressure of the cooling medium can be set.

The setting device for setting the temperature in a heating zone embodied as an induction furnace can be embodied as a frequency converter, so that the inductor of the induction furnace assigned to the frequency converter is activated with variable frequency and/or voltage level. This enables the heating of the steel strip to be set explicitly.

The setting device for setting the annealing temperature in an annealer can be embodied as a valve, for example a ball valve with rotary drive, wherein either an oxygen carrier (typically air or oxygen) or a fuel (e.g. heating oil, natural gas etc.) flows through the valve. The oxygen carrier and the fuel are burnt in the burner. Naturally a setting device can be present in each case for the oxygen carrier and the fuel, so that for example the volume ratio between oxygen and fuel can be kept constant (e.g. close to the stoichiometric ratio).

It is expedient for there to be an open-loop control device between the computing unit and the setting device. For high accuracy, it is advantageous when a closed-loop control device is disposed between the two.

It is advantageous for the heating or cooling zone in the transport direction of the steel strip to have at least two sections, wherein a first temperature measuring device and a first width measuring device are disposed before each section and a second temperature measuring device and a second width measuring device are disposed after each section, and each section has a computing unit for determining the ferritic phase fraction X. This enables the phase conversion to be determined even within the sections of the heating or cooling zone.

It is especially advantageous for each cooling zone to have at least one cooling nozzle with a setting device, and for the computing unit to be connected to the setting device for signaling purposes, so that the ferritic phase fraction can be set in the cooling zone. This enables the phase conversion within the cooling zone to be influenced quite explicitly, e.g. set under open-loop or closed-loop control.

In order to prevent the measured temperature values $T_1$ and T being corrupted by cooling water it is advantageous for a blower for blowing off the steel strip to be disposed before the first and/or the second temperature measuring device. The blower can for example involve an air nozzle, which blows cooling water off the steel strip using compressed air.

BRIEF DESCRIPTION OF THE DRAWINGS

Further advantages and features of the present invention emerge from the description given below of non-restrictive exemplary embodiments wherein, in the figures below:

FIG. 1A shows a side view and FIG. 1B shows a floor plan of a part of a hot-rolling mill with a device for carrying out the inventive method.

DESCRIPTION OF EMBODIMENTS

Figure 2:
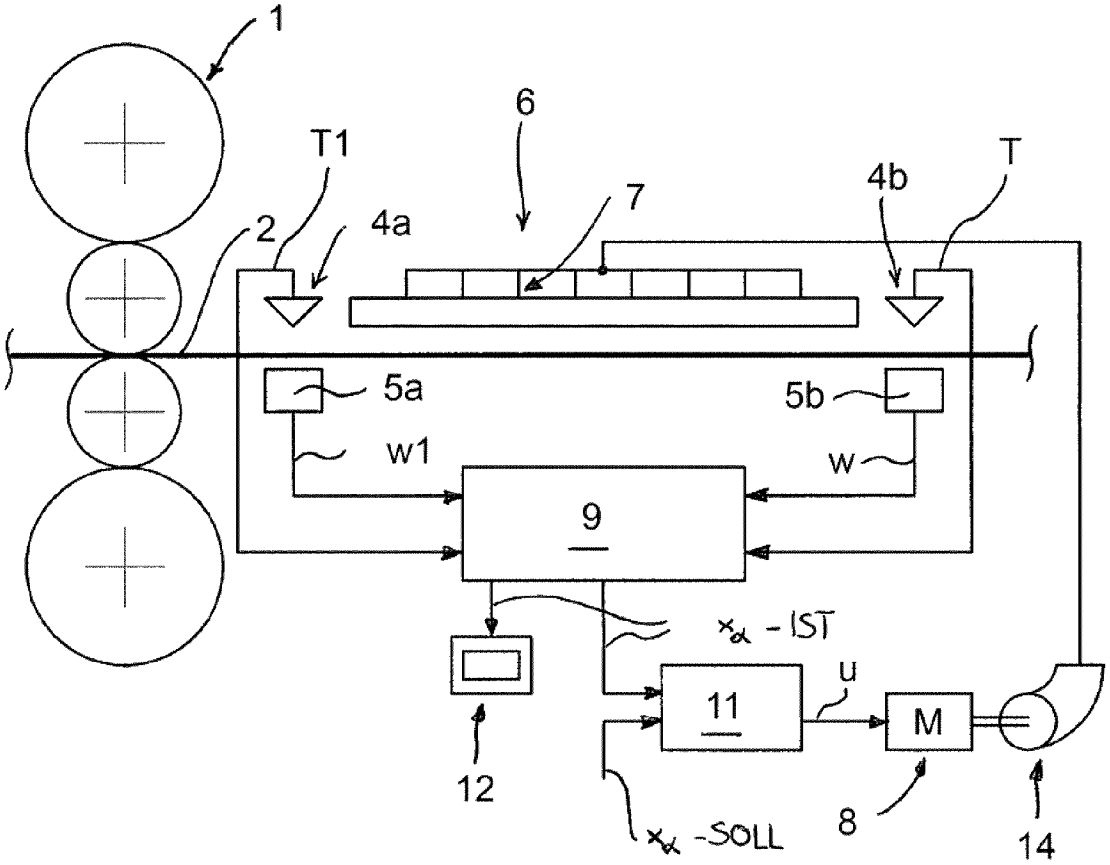
FIG. 2 shows a side view of a part of a hot-rolling mill with a variant of the device for carrying out the inventive method.

FIGS. 1A and 1B shows a rear part of a hot-rolling mill for manufacturing of a steel strip. In concrete terms a steel strip 2 made from a material CK60 with a thickness of 2 mm and a width of 1800 mm is produced in the hot rolling mill. The steel strip 2 is finish-rolled in the last roll stand 1 of the not completely shown finish-rolling train entirely in the austenitic state at a temperature of $T_{FM}$=800° C. and leaves the last roll stand 1 at a transport speed of e.g. 6 to 8 m/s. Immediately after the finish-rolling the temperature $T_1$ of the steel strip 2 is detected by a first temperature measuring device 4*a*, in concrete terms a pyrometer. At the same time the width $w_1$ of the steel strip 2 is detected by a first width measuring device 5*a*, which is embodied here as a camera. Subsequently the steel strip 2 is cooled in a cooling zone 6, by which the austenitic phase fraction γ in the structure of the steel strip 2 is converted at least partly into ferritic phase fractions α. The object of the invention is to determine the degree of the conversion γ→α in the cooling zone 6 or after the cooling zone (e.g. before coiling in the coiler 3). To this end the steel strip 2 is moved in the direction shown by the arrow through the cooling zone 6 and is cooled during this process. The strip 2 is cooled by a number of cooling nozzles which have not been shown additionally. After the cooling zone 6 the temperature T and the width w of the steel strip 2 are detected by a second temperature measuring device 4*b*, in concrete terms a pyrometer or a thermal camera, and a second width measuring device 5*b*. Subsequently the steel strip is wound into a coil by the coiler 3.

The knowledge of the temperatures and widths at at least two points of the strip before and after cooling, as well as under the prerequisite of an entirely austenitic initial state and the linear coefficient of thermal expansion for ferrite and austenite, enables the ferritic phase fraction $x_\alpha$ to be determined. This process will be outlined below:

The width w of a steel strip as a function of the temperature T is given by $w=w_0[1+\alpha(T-T_0)]$, wherein $w_0$ corresponds to the width of the steel strip at a reference temperature $T_0$ of typically 20° C. and α is the linear coefficient of thermal expansion. Naturally a higher-order polynomial approach can be used instead of the linear approach.

Since the austenitic phase γ has a different linear coefficient of thermal expansion $\alpha_\gamma$ than a ferritic phase $\alpha^{(i)}$ with $\alpha_\alpha^{(i)}$, the width of a steel strip, which has a fraction $x_\alpha^{(i)}$ of a ferritic phase (i) and a fraction $x_\gamma$ of the austenitic phase γ, can be written in a mixed approach as follows $$w = w_0\left[1 + x_\gamma\alpha_\gamma(T - T_0) + \sum_i x_\alpha^{(i)}\alpha_\alpha^{(i)}(T - T_0)\right]$$

If it is further assumed that only one ferritic phase α (typically ferrite) is present in the steel strip during the cooling, then the previous expression is simplified to $$w=w_0[1+x_\gamma\alpha_\gamma(T-T_0)+x_\alpha\alpha_\alpha(T-T_0)]$$

It is further known that the sum of the austenitic phase and all ferritic phases always amounts to 1, i.e.

$$x_\gamma+\Sigma_i x_\alpha^{(i)}=1$$

If only one ferritic phase is present, $x_\gamma+x_\alpha=1$ applies.

For the case with only one ferritic phase the following therefore applies $$w=w_0[1+(1-x_\alpha)\alpha_\gamma(T-T_0)+x_\alpha\alpha_\alpha(T-T_0)]$$

Thus the following applies for the ferritic phase fraction $$x_\alpha = \frac{\frac{w}{w_0} - 1 - \alpha_\gamma(T - T_0)}{(T - T_0)(\alpha_\alpha - \alpha_\gamma)}.$$

The width $w_1$ of the steel strip at a temperature $T_1$ during austenitic rolling is given by $$w_1=w_0[1+\alpha_\gamma(T_1-T_0)]$$

wherein $\alpha_\gamma$ is the linear coefficient of thermal expansion of austenite.

By combination of the last two equations the following applies $$x_\alpha = \frac{w[1 + \alpha_\gamma(T_1 - T_0)] - w_1 - w_1\alpha_\gamma(T - T_0)}{w_1[\alpha_\alpha(T - T_0) - \alpha_\gamma(T - T_0)]}.$$

In concrete terms, for $w_1$=1.8 in and $\alpha_\gamma=1\cdot10^{-5}$ 1/K and $\alpha_\alpha=6\cdot10^{-6}$ 1/K, a ferritic phase fraction of $x_\alpha$=20% is produced from the last equation at T=400° C. and a width of w=L7923 m.

FIG. 2 shows a further side view of a rear part of another hot-rolling mill for manufacturing a steel strip 2. The measured temperature values $T_1$ and T of the first and second temperature measuring devices 4*a* and 4*b*, as well as the measured width values $w_1$ and w of the first and second width measuring devices 5*a* and 5*b* are shown symbolically in this diagram. The measured values $T_1$, T, $w_1$ and w are processed in a computing unit 9, wherein, taking into consideration further physical parameters of the steel, the actual value of the ferritic phase fraction $x_\alpha$ is determined. On the one hand the actual value is shown in an output unit 12 embodied as a display, on the other hand the actual value is supplied to a closed-loop control device 11 which, by a required-actual comparison with a required value of the sum of the ferritic phase fraction $x_\alpha$, calculates a closed-loop control deviation not shown. Depending on the closed-loop control deviation the closed-loop control device outputs at least one setting value u, which under actual circumstances is supplied to an electric motor M as setting device 8. Depending on the setting value u the motor M changes its speed, which in turn influences the pressure of the cooling medium, which is fed by the centrifugal pump 14 to the individual cooling nozzles 7 of the cooling zone 6. Through this arrangement it is insured that the actual value of the sum of the ferritic phase fractions in the steel strip 2 largely corresponds to the required value, and does so essentially independently of transient changes in the operational control of the hot-rolling mill. The two width measuring devices 5*a*, 5*b* are embodied in this form of embodiment as so-called line-scan cameras below the strip 2. Not shown are the two blowers embodied as compressed air nozzles in the pyrometers 4*a*, 4*b*.

Figure 3:
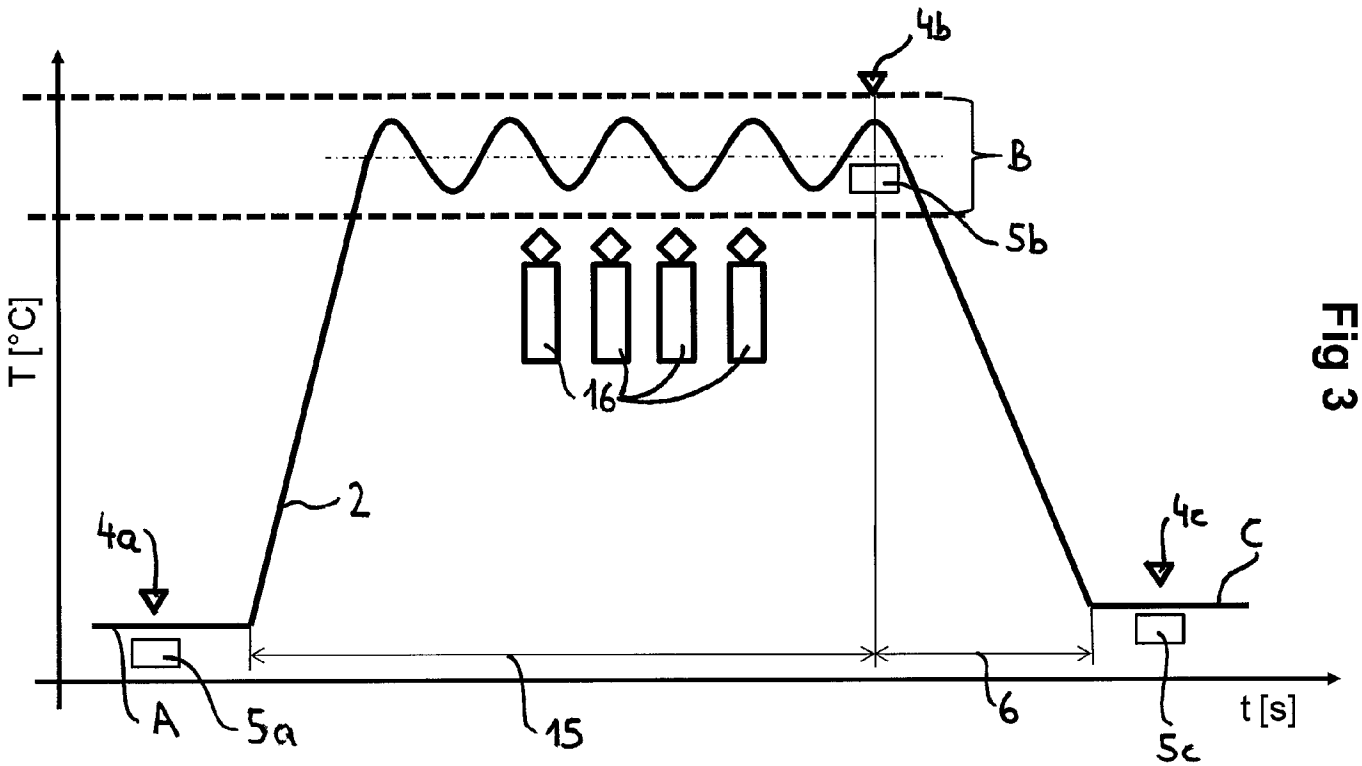
FIG. 3 shows a schematic diagram of a temperature curve in a continuous annealer for intercritical annealing of a steel strip

FIG. 3 shows as an example a schematic diagram of the temperature management in a so-called continuous annealer for manufacturing a TRIP steel cold-rolled strip. In the input area of the system the width $w_1$ and the temperature $T_1$ of the steel strip 2 present in an initial state A are measured. This is done by a first width measuring device 5*a* and a first temperature measuring device 4*a*. In the initial state A the steel strip 2 contains ferritic and perlitic phase fractions. Subsequently the steel strip 2 is introduced into the heating zone 15 embodied as an annealer, wherein the steel strip is heated up. In the heating zone 15 the steel strip is heated by a number of burners 16 disposed over the longitudinal extent of the heating zone, through which the ferritic structure fractions convert partly into an austenitic structure. During the annealing the steel strip is present in an intermediate state B, which is characterized by the coexistence of ferritic and austenitic phases. The annealing temperature is set during a defined passage speed through the continuous annealer so that the actual austenite fraction in the steel strip before cooling corresponds as precisely as possible to the required value. At the end of the heating zone 15 the width w and the temperature T of the steel strip 2 present in the intermediate state B are again measured; this is done by the second width measuring device 5*b* and the second temperature measuring device 4*b*. The actual austenite fraction is determined in accordance with the method for determining the ferritic phase fraction $x_\alpha$ after the heating of a steel strip, taking into consideration w, $w_1$, T, $T_1$, wherein the sum of the austenitic phase and all ferritic phases always amounts to 1. Subsequently the steel strip 2 is cooled in a rapid cooling zone 6, so that a preferred ferritic-bainitic (if possible with a martensitic residual fraction) structure with residual austenite islands is set in the cooled steel strip 2. Immediately after the end of the cooling zone 6 the width $w_2$ and the temperature $T_2$ of the steel strip 2 present in the end state C are measured; this is done by the third width measuring device 5*c* and the third temperature measuring device 4*c*. The phase fractions in the cooled steel strip 2 are determined in accordance with the method for determining the ferritic phase fraction $x_\alpha$ after the cooling of a steel strip, taking into consideration $w_1$, $T_1$, $w_2$ and $T_2$.

Although the invention has been illustrated and described in greater detail by the preferred exemplary embodiments, the invention is not restricted by the disclosed examples and other variations can be derived herefrom by the person skilled in the art, without departing from the scope of protection of the invention.

LIST OF REFERENCE CHARACTERS

1 Roll stand
2 Steel strip
3 Coiler
4 Temperature measuring device
4*a*, 4*b*, 4*c* First, second and third temperature measuring devices
5 Width measuring device
5*a*, 5*b*, 5*c* First, second and third width measuring devices
6 Cooling zone
7 Cooling nozzle
8 Setting device
9 Computing unit
11 Closed-loop control device
12 Output unit
14 Centrifugal pump
15 Heating zone
16 Burner
α Linear coefficient of thermal expansion
T Temperature
u Setting value
w Width
x Phase fraction
$x_\alpha$ Ferritic phase fraction
$x_\gamma$ Austenitic phase fraction
A Initial state: Ferrite and perlite
B Intermediate state: Intercritical area (ferrite and austenite coexistence)
C End state: Ferrite, bainite, martensite and residual austenite

The invention claimed is:

1. A method for determining a ferritic phase fraction $x_\alpha$ of an at least partly converted steel strip after at least one of heating or cooling of the steel strip, comprising the following method steps in sequence:

measuring a width $w_1$ and a temperature $T_1$ of the steel strip, wherein the steel strip has a ferritic phase fraction $x_{\alpha 1}$ during the measurement;

heating or cooling the steel strip, wherein at least a partial phase conversion from a ferritic state α into an austenitic state γ takes place in the steel strip during heating or at least a partial phase conversion from an austenitic state γ into a ferritic state α takes place in the steel strip during cooling;

measuring a width w and a temperature T of the at least partly converted steel strip and;

determining the ferritic phase fraction $x_\alpha$ of the at least partly converted steel strip through $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]},$$

wherein $T_0$ is a reference temperature and $\alpha_\alpha$ and $\alpha_\gamma$ are linear coefficients of thermal expansion of ferrite and austenite, respectively.

2. A method for determining a ferritic phase fraction $x_\alpha$ of an at least partly converted steel strip after heating of the steel strip comprising the following method steps in sequence:

measuring a width $w_1$ and a temperature $T_1$ of the steel strip, wherein the steel strip is entirely in a ferritic state with $x_{\alpha 1}=1$ during the measurement;

heating the steel strip, wherein at least a partial phase conversion from a ferritic state α into an austenitic state γ takes place in the steel strip;

measuring a width w and a temperature T of the at least partly converted steel strip; and determining the ferritic phase fraction $X_\alpha$ of the at least partly converted steel strip through $$x_\alpha = \frac{-w - w\alpha_\alpha(T_1 - T_0) + w_1 + w_1\alpha_\gamma(T - T_0)}{w_1[-\alpha_\alpha(T - T_0) + \alpha_\gamma(T - T_0)]}.$$

wherein $T_0$ is a reference temperature and $a_\alpha$ and $a_\gamma$ are linear coefficients of thermal expansion of ferrite and austenite, respectively.

3. The method as claimed in claim 1, further comprising cooling the steel strip in a cooling zone before the measurement of the width $w_1$ and of the temperature $T_1$.

4. The method as claimed in claim 1, further comprising annealing the steel strip and then measuring the width w and the temperature T of the at least partly converted steel strip during or after the annealing.

5. The method as claimed in claim 4, further comprising setting an annealing duration and/or an annealing temperature during the annealing as a function of the ferritic phase fraction $x_\alpha$.

6. The method as claimed in claim 5, setting the annealing duration and/or the annealing temperature under open-loop or closed-loop control.

7. A method for determining a ferritic phase fraction $x_\alpha$ of an at least partly converted steel strip after cooling of the steel strip comprising the following method steps in sequence:

measuring a width $w_1$ and a temperature $T_1$ of the steel strip, wherein the steel strip is entirely in an austenitic state γ with $x_{\alpha 1}=0$ during the measurement;

cooling the steel strip, wherein at least a partial phase conversion from an austenitic state γ into a ferritic state α takes place in the steel strip;

measuring a width w and a temperature T of the at least partly converted steel strip; and determining the ferritic phase fraction $x_\alpha$ of the at least partly converted steel strip through $$x_\alpha = \frac{-w - w\alpha_\gamma(T_1 - T_0) + w_1 + w_1\alpha_\gamma(T - T_0)}{w_1[-\alpha_\alpha(T - T_0) + \alpha_\gamma(T - T_0)]}.$$

wherein $T_0$ is a reference temperature and $a_\alpha$ and $\alpha_\gamma$ are linear coefficients of thermal expansion of ferrite and austenite, respectively.

8. The method as claimed in claim 1, further comprising hot rolling the steel strip before the measurement of the width $w_1$ and the temperature $T_1$.

9. The method as claimed in claim 7, further comprising measuring the width w and the temperature T of the at least partly converted steel strip during or after the cooling of the steel strip in a cooling zone.

10. The method as claimed in claim 9, further comprising setting the cooling as a function of the ferritic phase fraction $x_\alpha$.

11. The method as claimed in claim 10, further comprising setting the cooling duration and/or the cooling intensity during cooling under open-loop control or closed-loop control.

12. A computer program product comprising a non-transitory computer readable storage medium, and a computer program comprised of computer program code stored on the medium, wherein the program code is programmed to cause a computer to control a performance of the method of claim 1, wherein the program code includes values for the width $w_1$ and the temperature $T_1$ of the steel strip before the at least partial phase conversion, for the width w and the temperature T of the steel strip after the at least partial phase conversion, and for physical parameters of the steel strip supplied by performing the method of claim 1; and the computer program has a computing module for computing the ferritic phase fraction $x_\alpha$ of the at least partly converted steel strip through $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]}.$$

wherein $T_0$ is a reference temperature and $a_\alpha$ and $a_\gamma$ are linear coefficients of thermal expansion of ferrite and austenite, respectively.

13. An apparatus for determining a ferritic phase fraction $x_\alpha$ of an at least partly converted steel strip after at least one of heating or cooling of the steel strip, the apparatus carrying out the method as claimed in claim 1, the apparatus comprising:

a first temperature measuring device for measuring a temperature $T_1$ and a first width measuring device for measuring a width $w_1$ of the steel strip, and being disposed before a cooling zone or a heating zone, the cooling zone being configured for cooling the steel strip or the heating zone being configured for heating the steel strip;

a second temperature measuring device for measuring a temperature T and a second width measuring device for measuring a width w of the steel strip, and being disposed after the cooling zone or the heating zone; and a computing unit for determining the ferritic phase fraction $x_\alpha$ of the at least partly converted steel strip through $$x_\alpha = \frac{-w - wx_{\alpha 1}\alpha_\alpha(T_1 - T_0) - w\alpha_\gamma(T_1 - T_0) + wx_{\alpha 1}\alpha_\gamma(T_1 - T_0) + w_1 + w_1\alpha_\gamma(T - T_0)}{w_1[-\alpha_\alpha(T - T_0) + \alpha_\gamma(T - T_0)]},$$

wherein $T_0$ is a reference temperature and $a_\alpha$ and $a_\gamma$ are linear coefficients of thermal expansion of ferrite and austenite, respectively, wherein the computing unit is connected for signaling purposes to all of the first temperature measuring device, the first width measuring device, the second temperature measuring device and the second width measuring device.

14. The apparatus as claimed in claim 13, wherein the cooling zone has at least one cooling nozzle with a respective setting device for the cooling nozzle, or the heating zone has at least one heating element with a respective setting device for the heating element; and the computing unit is connected for signaling purposes to the setting device, so that the computing unit can set the ferritic phase fraction $x_\alpha$ of the at least partly converted steel strip.

15. The apparatus as claimed in claim 14, further comprising an open-loop control device or a closed-loop control device disposed between the computing unit and the setting device, wherein the open-loop control device or the closed-loop control device is connected for signaling purposes to the setting device.

* * * * *